US007033199B2

(12) United States Patent
Funatsu

(10) Patent No.: US 7,033,199 B2
(45) Date of Patent: Apr. 25, 2006

(54) ELECTRICAL CONNECTOR APPARATUS WITH METAL SHELL

(75) Inventor: Akira Funatsu, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 10/990,533

(22) Filed: Nov. 18, 2004

(65) Prior Publication Data

US 2005/0112928 A1 May 26, 2005

(30) Foreign Application Priority Data

Nov. 21, 2003 (JP) ..... 2003-392267

(51) Int. Cl.
*H01R 4/50* (2006.01)
*H01R 13/25* (2006.01)

(52) U.S. Cl. ..... 439/341; 439/138; 439/326

(58) Field of Classification Search ..... 439/341, 439/326, 338, 135–138
See application file for complete search history.

(56) References Cited

U.S. PATENT DOCUMENTS 5,066,241 A * 11/1991 Hills ..... 439/260
5,478,249 A * 12/1995 Crestin ..... 439/138
5,669,781 A * 9/1997 Ishida ..... 439/326
6,113,409 A * 9/2000 Park ..... 439/310
6,171,127 B1 * 1/2001 Hebblewhite et al. ..... 439/341

FOREIGN PATENT DOCUMENTS

GB 000669681 A2 * 8/1995
JP 2003-168527 6/2003

* cited by examiner

*Primary Examiner*—Michael C. Zarroli
(74) *Attorney, Agent, or Firm*—Takeuchi&Kubotera,LLP

(57) ABSTRACT

An electrical connector apparatus consists of first and second electrical connectors (2, 3). The second electrical connector (3) is inserted into the first electrical connector (2) in an oblique direction and then fully plugged to the first electrical connector (2) by turning the second electrical connector (3). The first electrical connector includes an insulative housing (22), at least one contact element (24) provided in the insulative housing (22), and a metal shutter (28) pivoted to the insulative housing (22) to cover the contact element (24) in the insulative housing (22). The second electrical connector (3) includes a plate member (320) which enters between the metal shutter (28) and the contact element (24) upon plugging.

8 Claims, 9 Drawing Sheets

ELECTRICAL CONNECTOR APPARATUS WITH METAL SHELL

BACKGROUND OF THE INVENTION

1. Field of the Invention

The present invention relates to an electrical connector system provided on a portable information device, such as a PDA, and especially to an electrical connector system with an electrical connector being inserted into a mating electrical connector at an angle or in an oblique direction.

2. Description of the Related Art

JP 2003-168527 discloses a conventional electrical connector system of this type. The electrical connector system consists of first and second electrical connectors. In order to reduce the plugging/unplugging force, the second electrical connector is plugged into the first electrical connector in an oblique direction and then turned to complete the plugging. In order to permit the second electrical connector being inserted into the first electrical connector at an initial plugging stage, the first electrical connector has a tapered outer face extending forwardly. Also, it has a relatively large shutter to protect its contact elements in the insulative housing. This shutter is slid into the interior against a coil spring by the second electrical connector inerted into the first electrical connector.

However, it is necessary to provide a relatively large storage space in the first electrical connector to house the retreated shutter. In addition, the plugging angle between the first and second lelectrical connectors is determined by the angle of the tapered outer face of the first electrical connector so that it is impossible to make plugging at a given angle. Moreover, the terminals make contact at the final stage of plugging, providing the limited cleaning effect.

SUMMARY OF THE INVENTION

Accordingly, it is an object of the invention to provide an electrical connector apparatus having a small storage space for the metal shutter.

It is another object of the invention to provide an electrical connector apparatus capable of plugging at a given angle.

It is still another object of the invention to provide an electrical connector apparatus having the improved cleaning effect.

According to an aspect of the invention there is provided an electrical connector apparatus consisting of first and second electrical connectors, with the second electrical connector inserted into the first electrical connector in an oblique direction and then fully plugged to the first electrical connector by turning the second electrical connector. The first electrical connector comprising an insulative housing, at least one contact element provided in the insulative housing, and a metal shutter pivoted to the insulative housing to cover the contact element in the insulative housing. The second electrical connector comprising a plate member which, when the first and second electrical connectors are plugged to each other, enters between the metal shutter and the contact element.

According to another aspect of the invention there is provided an electrical connector apparatus consisting of a first electrical connector and a second electrical connector. The first electrical connector comprising an insulative housing with a pair of guide walls extending forwardly and connected by a lower curved guide face extending forwardly to provide a convex front face and at least one first contact element extending forwardly and being flexible in a direction perpendicular to a plugging direction. The second electrical connector comprising a plate member to define a plugging space into which the guide walls are inserted in an oblique angle at an initial plugging stage and fitted by turning the second electrical connector to a full plugging stage, and at least one second contact element extending forwardly so as to come into contact with the first contact element from the initial plugging stage to the full plugging stage.

With such structures as described above, it is possible to make a smooth oblique plugging. The contact elemetns of the first and second electrical connectors are brought into contact with each other from the initial plugging stage to the complete plugging stage, thereby providing the improved cleaning effect.

The fitst electrical connector may include a metal shutter rotatably attached to the insulative housing to cover the first contact element. The metal shutter may be turned upwardly by the plate member of the second electrical connector so as to permit the plate member to enter between the first contact element and the metal shutter, thereby minimizing the storage space for the metal shutter. The metal shutter may be housed in the plugging space of the second electrical connector, thereby minimizing the storage space for the metal shutter.

The first electrical connector may be secured to a first member with a regulation projection and the second electrical connector may be secured to a second member with a regulation recess for engagement with the regulation projection to regulate a the angle at which the second electrical connector is inserted into the first electrical connector. The first regulation member may be a recess provided in the first member and the second regulation member is a raised rib provided on the second member and having a tapered face.

According to the invention, the metal shutter is turned to the retreated position so that there is no need for a large storage space, permitting miniaturization of the apparatus. Also, it is possible to make plugging at a given angle. The contact elements are brought into contact at the initial plugging stage and subject to sliding movement, thereby providing the improved cleaning effect. The metal shutter shields the plugging section, minimizing an EMI (electromagnetic interference).

DESCRIPTION OF THE PREFERRED EMBODIMENTS

A preferred embodiment of the invention will now be described with reference to the accompanying drawings.

1. Uses

Figure 1:
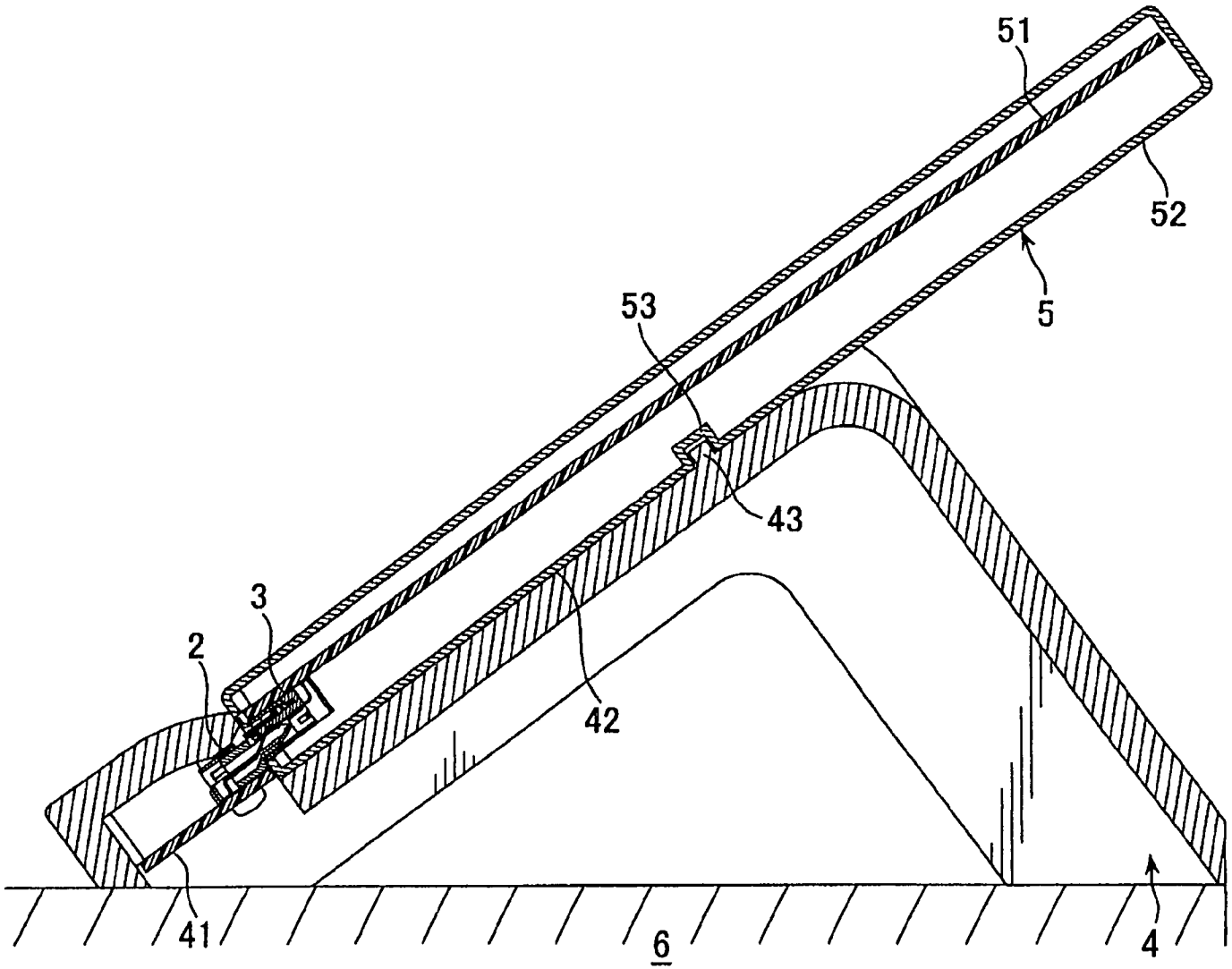
FIG. 1 is a sectional view of a cradle and a case wherein an electrical connector apparatus according to an embodiment of the invention is installed.
Figure 2:
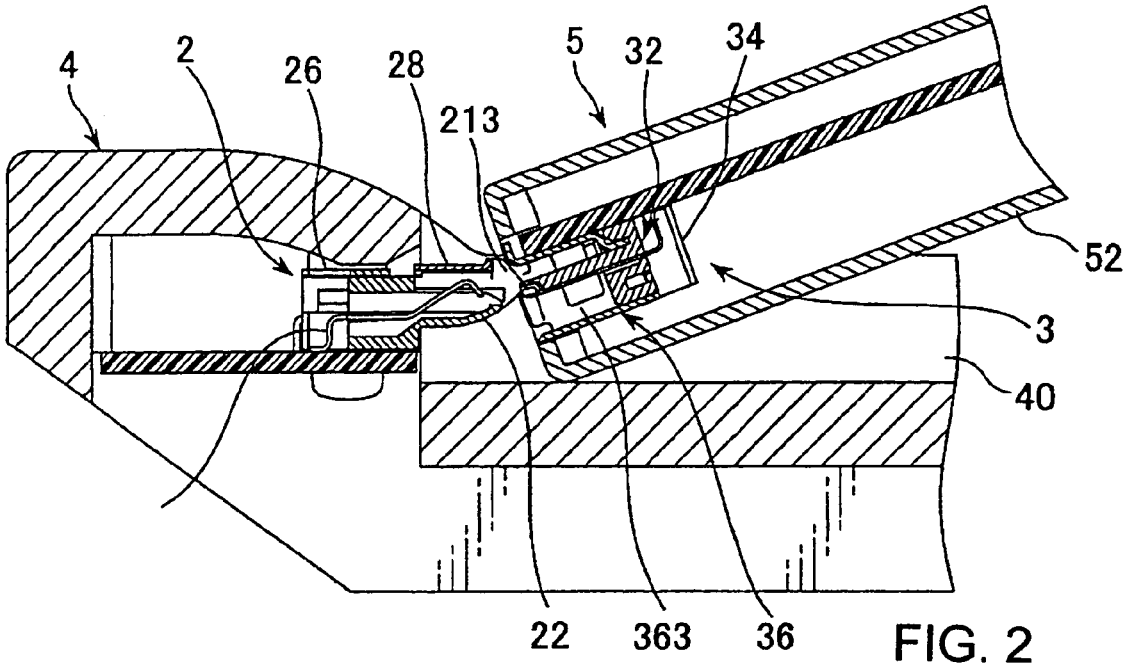
FIG. 2 is a sectional view of the electrical connector apparatus.

In FIGS. 1 and 2, an electrical connector system 1 consists of a first or female connector 2 and a second or male connector 3. The female connector 2 and the male connector 3 are secured to a cradle 4 and a case 5, respectively. The cradle 4 is made by bending a rectangular resinous plate at right angles along a center line to provide an L-shaped section. It is placed on a table 6, with the central portion upward, for use. The case 5 is made of a rectangular resinous plate. It is movable on the cradle 4 that is at rest. A case receiving section 40 is provided on the bottom 42 of the cradle 4.

The female connector 2 and the male connector 3 are electrically connected to boards 41 and 51 which are disposed in the cradle 4 and the case 5, respectively. When the case 5 is fully attached to the cradle 4 as shown in FIG. 1, the male connector 3 is plugged to the female connector 2 to electrically connect the boards 51 and 41. A projection 43 on the bottom 42 of the cradle 4 fits in a recess 52 of the case 5 to lock the case 5 to the cradle 4.

2. Female Connector

Figure 3:
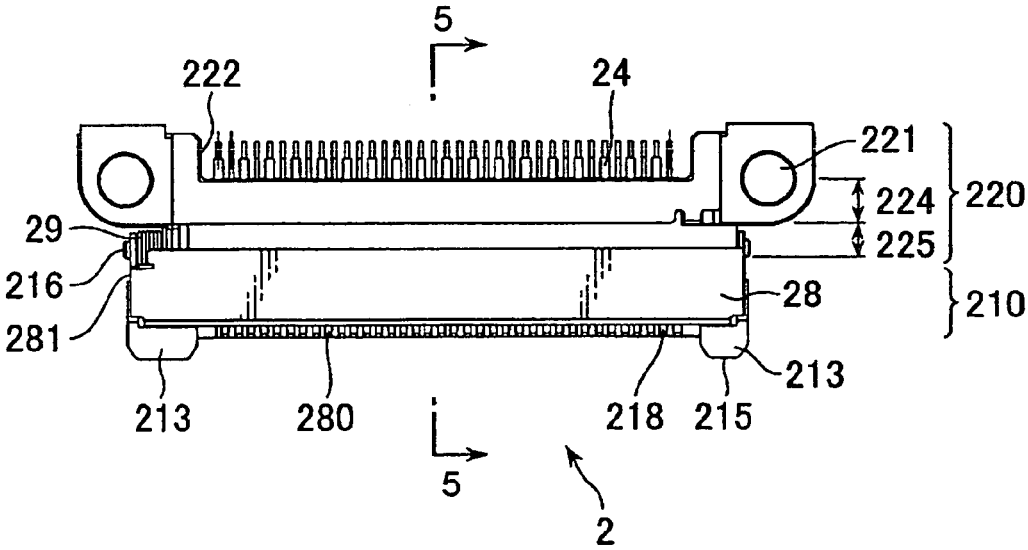
FIG. 3 is a top view of a female electrical connector of the electrical connector apparatus.
Figure 4:
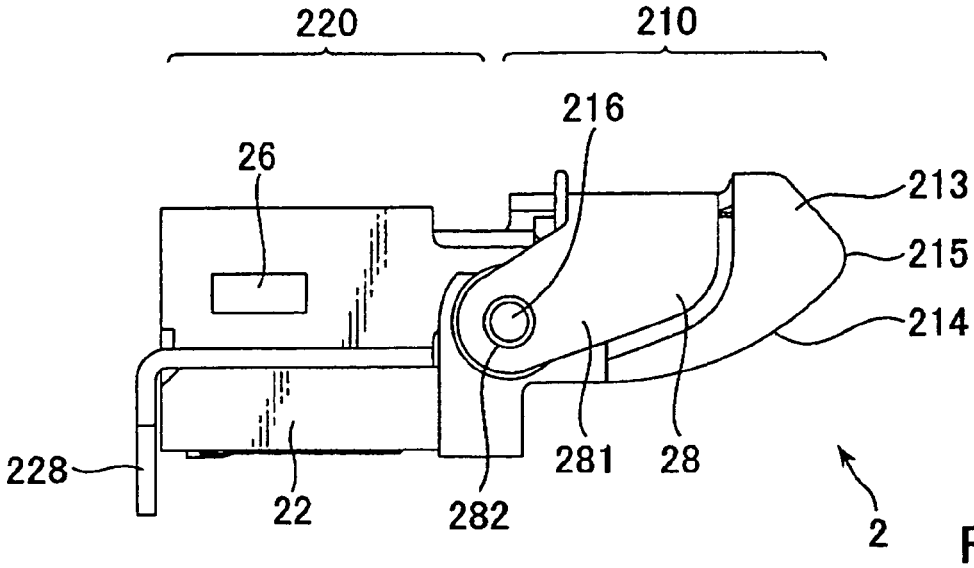
FIG. 4 is a side view of the female electrical connector.
Figure 5:
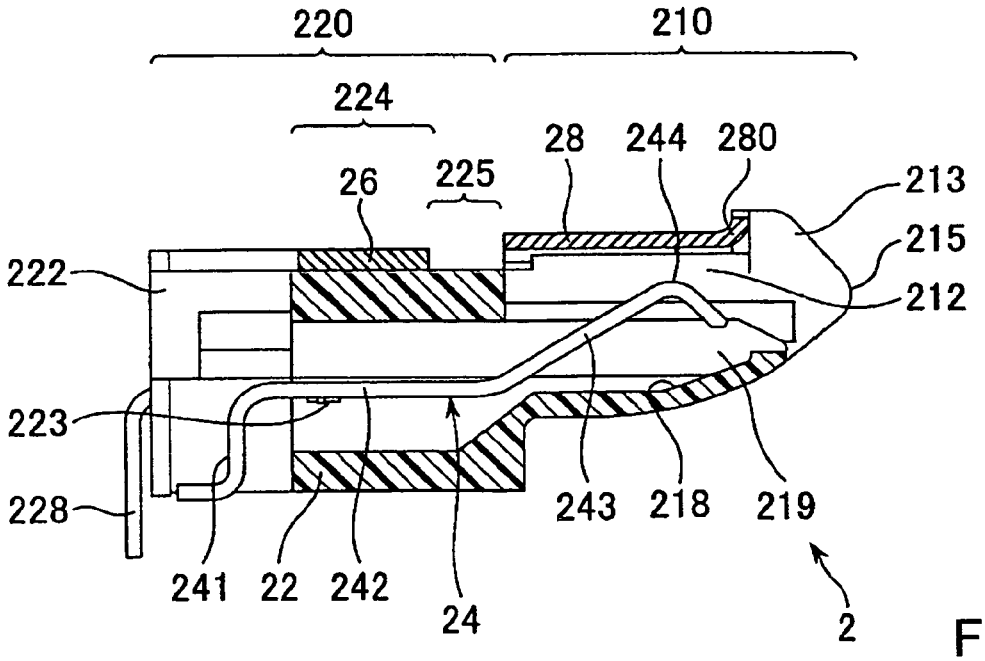
FIG. 5 is a sectional view taken along line 5—5 of FIG. 3.

The structure of the female connector 2 will be described with reference to FIGS. 3–5. The female connector 2 includes a female insulative housing 22, female terminals 24, a female metal shell 26, a metal shutter 28, and a coil spring 29.

2-1. Female Insulative Housing

The female insulative housing 22 includes a front section 210 to be plugged to the male connector and a rear section 220. The front section 210 has an opening in its top face 212 except for opposite edges of the female insulative housing 22. The movable metal shutter 28 normally closes the opening in the top face 212. A pair of guide walls 213 are provided on the opposite edges of the front section 210 to help plugging between the female and male connectors 2 and 3. The guide walls 213 are connected by a lower guide surface 214 which is curved upwardly to a pair of convex front faces 215. A shaft 216 is provided at the rear end of the guide face 214 to rotatably support the metal shutter 28. A lower face step-down section 217 is provided rear the front faces 215 of the guide walls 214. A plurality of terminal grooves 218 are provided in an open upper face 212 of the step-down section 217.

Unlike the front section 210, the rear section 220 has a front rectangular section and is wider than the front section 210. A pair of screw holes 221 are provided in opposite side portions to secure the board. The opposite side portions extend downwardly to provide a pair of rear vertical walls 222. The female insulative housing 22 is screwed to the board 41 with the screw holes 221. A plurality of terminal fixing grooves 223 are provided in the rear section 220 corresponding to the terminal grooves 218 of the front section 210.

2-2. Female Terminal

The female terminal 24 includes a fixing section 241, a support section 242, and a spring section 243. The fixing section 241 is soldered to the board 41 and disposed between the rear vertical walls 222. The support section 242 is press fitted in the terminal fixing groove of the rear section 220 to support the female terminal 24 in place within the female insulative housing 22. The spring section 243 is brought into spring contact with a male terminal of the male connector 3 when the female and male connector 2 and 3 are plugged to each other. It extends through a replacement space 219 above the terminal groove 218 and has a free end near the front face 215 of the guide projection 213. When it is brought into contact with the male terminal 34, it is flexed in a direction perpendicular to the plugging direction into the terminal groove 218 of the female insulative housing 22. It has a V-shaped contact portion 244 to facilitate contact with the male terminal 34 of the male connector 3.

2-3. Female Metal Shell

The female metal shell 26 is made by bending and cutting a thin metal sheet so as to cover the upper face 224 of the rear section 220 of the female insulative housing 22 down to the rear portions of the screw holes 221, projecting to the board 41 to provide an extended wall 228, which connects the female metal shell 26 to a ground of the board 41. The female metal shell 26 does not cover the upper face of the front portion 225 of the rear section 220 so that when the metal shutter 28 is opened, it is prevented to abut against the metal shutter 28.

2-4. Metal Shutter and Coil Spring

The metal shutter 28 is rotatably provided above the opened upper face 212 of the female insulative housing 22 so as to cover the female terminals 24. The rotary motion or open/close operation of the metal shutter 28 is made by the contact with the male connector 3. To facilitate the open operation by the male connector 3, the front edge 280 of the metal shutter 280 is curved upwardly.

A pair of opposite sides of the metal shutter 28 are bent downward to provide a pair of pivot arms 281, which cover the rear portions of the guide walls 213. The metal shutter 28 is rotatably attached to the female insulative housing 22 by fitting the pivot arms 281 over the pivot shaft 216. The coil spring 29 is put around the pivot shaft 216 between the pivot arm 281 and the female insulative housing 22 for biasing the metal shutter 28 to normally close the opened upper face 212. Consequently, the metal shutter 28 is kept in the closed position unless it receives a force greater than the coil spring 29. As a result, the female terminals 24, especially the spring sections 243, are shielded from the outside both electronically and mechanically.

3. Male Connector

Figure 6:
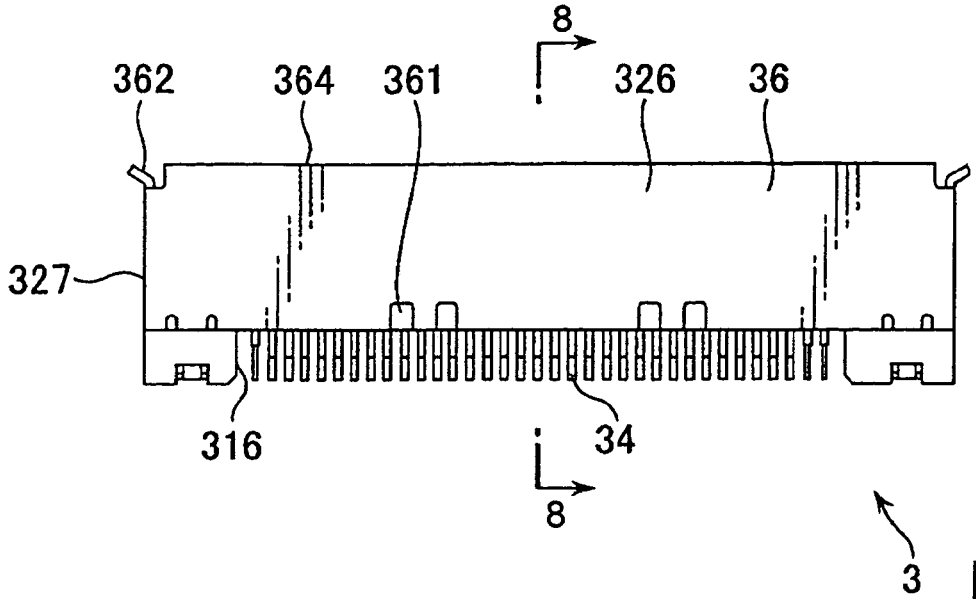
FIG. 6 is a bottom view of a male electrical connector of the electrical connector apparatus.
Figure 7:
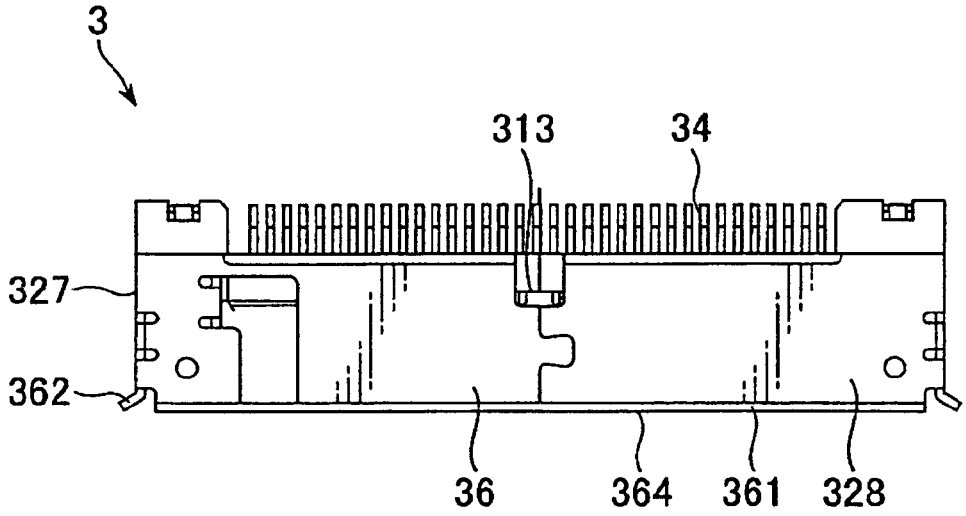
FIG. 7 is a top view of the male electrical connector.
Figure 8:
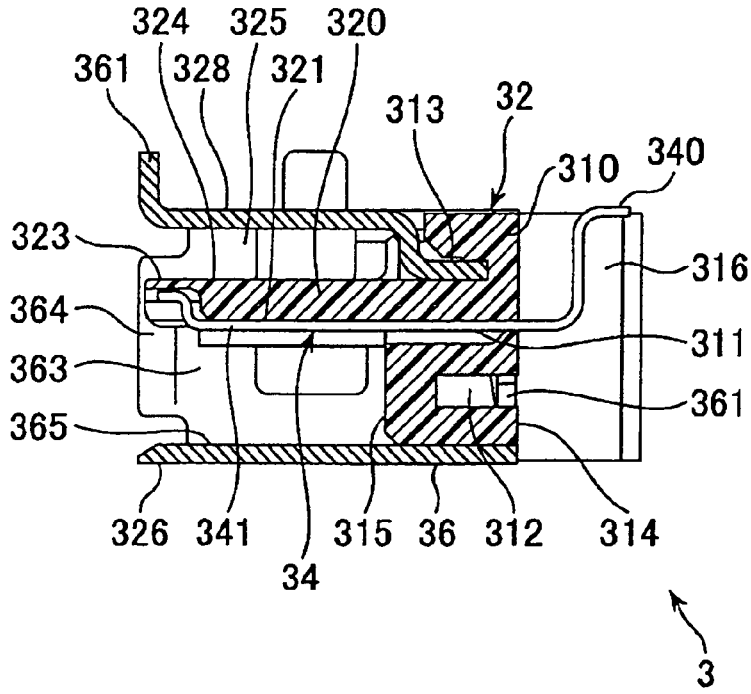
FIG. 8 is a sectional view taken along line 8—8 of FIG. 6.

In FIGS. 6–8, the male connector 3 includes a male insulative housing 32, a plurality of male terminals 34, and a male metal shell 36.

3-1. Male Insulative Housing

The male insulative housing 32 includes a rear section 310 and a plate section 320 extending forwardly from the rear section 310 and having a predetermined width. The rear section 310 has a plurality of terminal fixing holes 311 for arranging and fixing terminals 34 and upper and lower engaging grooves 312 and 313 to fix the male metal shell 36 (as shown upside down in FIG. 8). The upper engaging groove 312 extends laterally along the rear wall 314 while the lower engaging groove 313 extends laterally along the front wall 315 and is narrower than the upper engaging groove 312. These engaging grooves 312 and 313 engage the engaging edge 361 to secure the male metal shell 36 to the male insulative housing 32. The male insulative housing 32 has a pair of rear vertical walls 316 to flank exposed portions of the male terminals 34.

The plate section 320 of the male insulative housing 32 has a plurality of terminal grooves 321 corresponding to the terminal fixing holes 311 and a thin front edge 323 along which the front ends of male contacts are bent.

3-2. Male Terminals

The male terminal includes a fixing section 340 and a support section 341. The fixing sections 340 are soldered to a board 51. They are arranged between the rear vertical walls 316 of the male insulative housing 32 and exposed to the outside. The support section 341 is press fitted in the terminal fixing hole 311 and arranged on the plate section 320 to support the male terminal 34 in a predetermined position within the male insulative housing 32. Also, it comes into contact with a female contact of the female connector 2 when the male and female connectors 3 and 2 are plugged to each other. Unlike the spring female terminal 24, it is fixed upon contact with the female terminal 24. Its front portion is bent to the thin edge 323 to facilitate contact with the female terminal 24.

3-3. Male Metal Shell

The male metal shell 36 is made by bending and cutting a thin metal plate so as to have a substantially cylindrical shape which covers the rear section 310 and the upper face 326 and side faces 327, and the bottom face 328 of the male insulative housing 32. The front edges 360 and 362 of the male metal shell 36 are bent outwardly to avoid collision with the female connector 2 upon plugging. The plugging space 363 for receiving the female connector 2 is defined by the male metal shell 36 and the rear section 310 of the male insulative housing 32. The plate section 320 of the male insulative housing 32 extends forwardly to the entry opening 364 of the plugging space 363.

4. Operation

Figure 9:
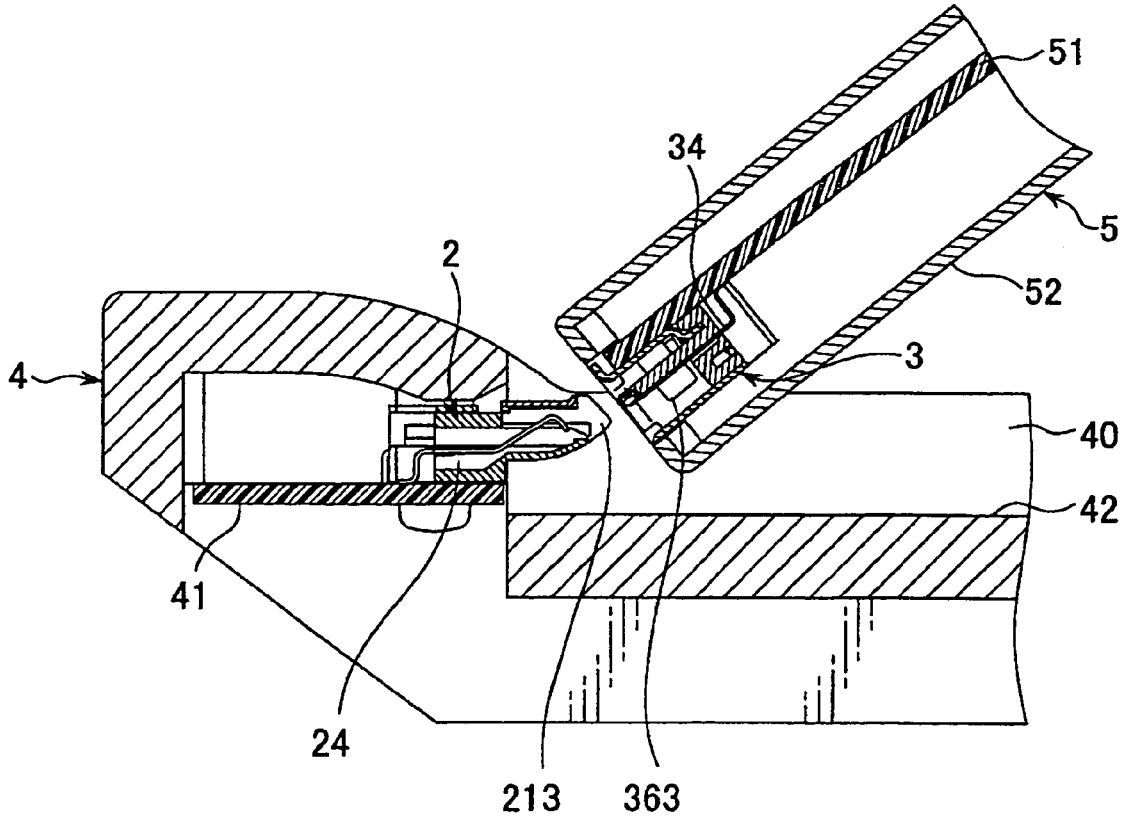
FIGS. 9–13 are sectional views showing in sequence how to plug the male and female electrical connectors.

As shown in FIG. 9, when the case 5 approaches the cradle 4 from obliquely above, the male connector 3 approaches the female connector 2 from obliquely above.

Figure 10:
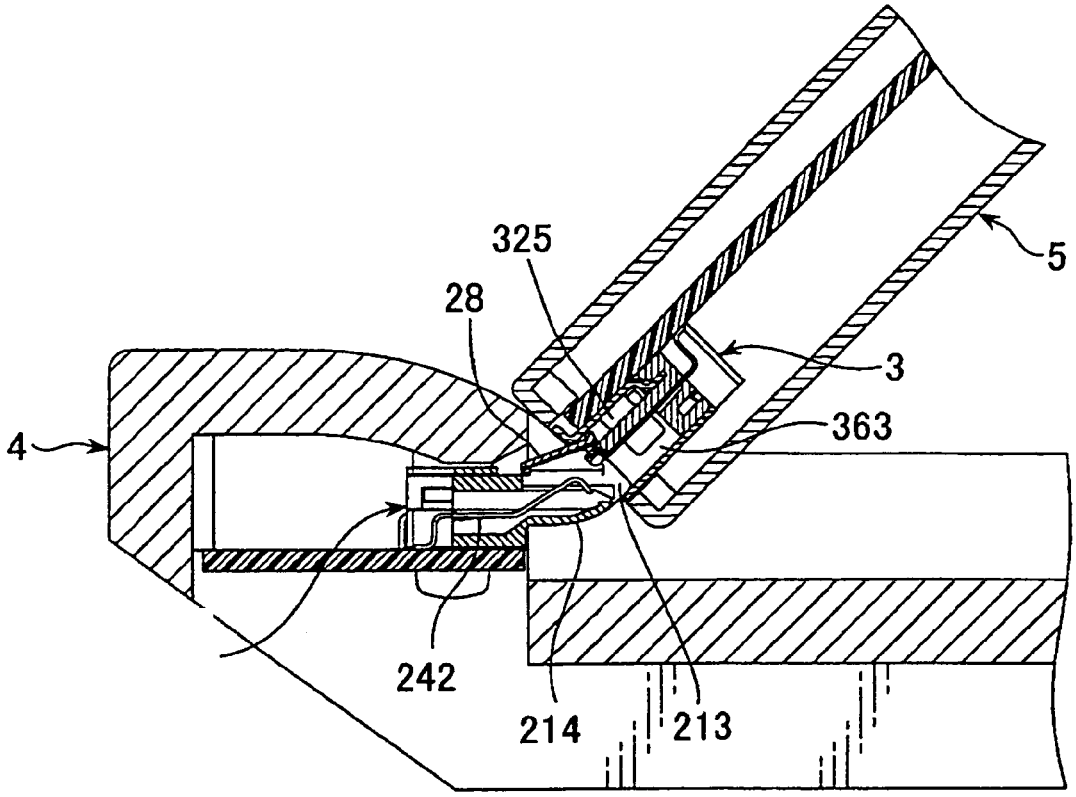

As shown in FIG. 10, the guide walls 213 of the female connector 2 enter the plugging space 363 of the male connector 3 along the guide face 214 through the contact between the front face 213 and the male metal shell 36 ("initial oblique plugging stage"). The front plate section 320 with the thin edge 323 comes into contact with the front edge 280 of the metal shutter 28, turning it upwardly and enters under the metal shutter 28. The metal shutter 28 enters the escape space 325 defined by the plate section 320 of the male connector 3 and the bottom of the male metal shell 36.

Figure 11:
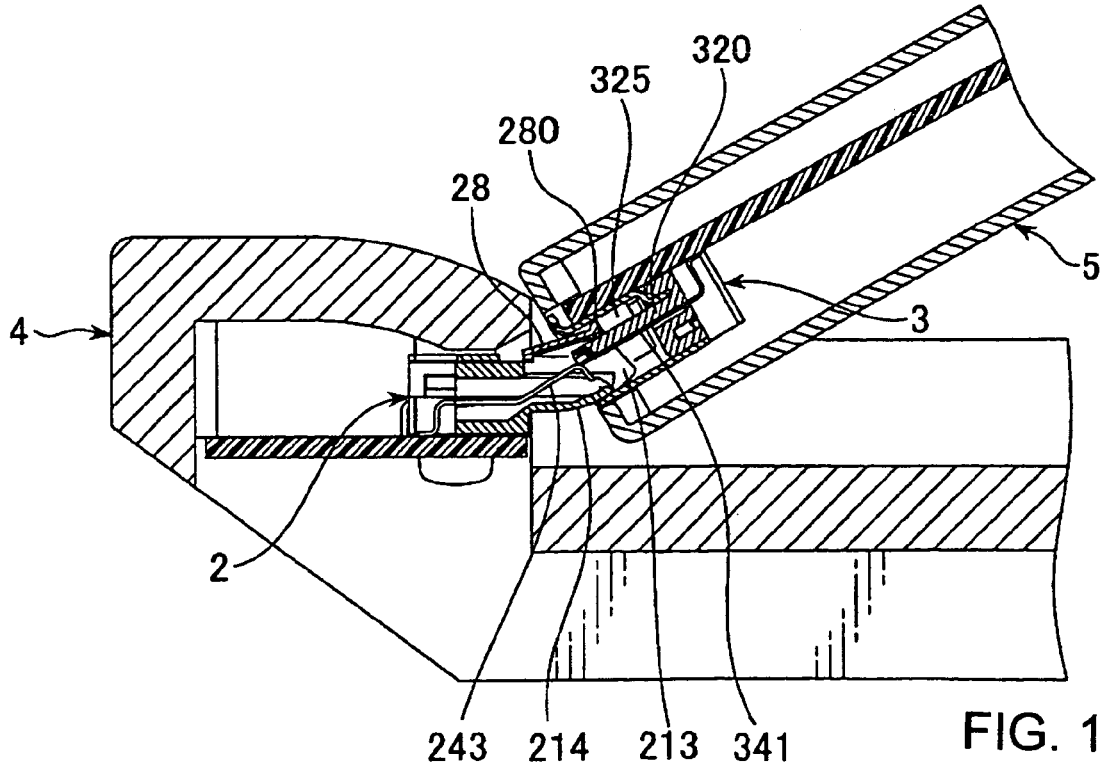

As shown in FIG. 11, the male connector 3 is further inserted into the female connector 2 by turning the case 5 along the cradle 4, turning the male connector 3 along the curved guide face 214 of the female connector 2. As the plate section 320 of the male connector 3 turns downwardly, the metal shutter 28 of the female connector 2 is returned to the original position by the coil sprint 29. The support sections 341 of the male terminals 34 come into spring contact with the contact portions 341 of the female terminals 24. This spring contact between the contact portions 244 of the female terminals 24 and the male terminals 34 is kept until the male connector 3 is unplugged from the female connector 2. In this way, the female terminals 24 slide on the male terminals 34 during the plugging operation, thus providing the cleaning effect.

Figure 12:
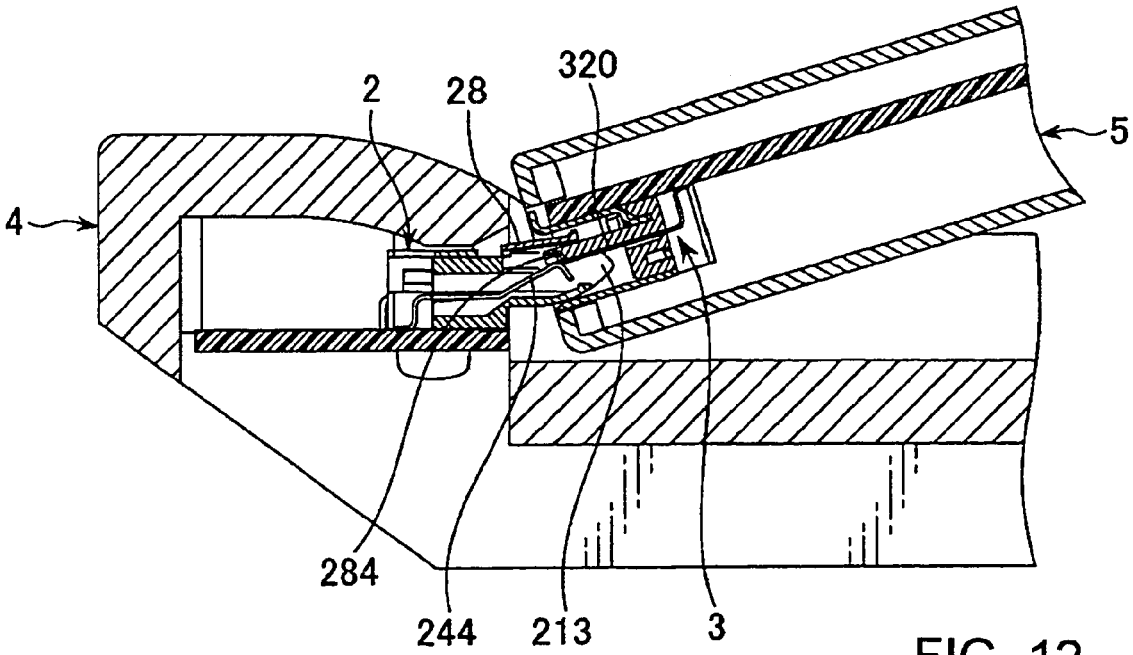

As shown in FIG. 12, when the case 5 further approaches the cradle 4, the plate section 320 of the male connector 3 enters deeply in the space 284 between the metal shutter 28 and the female terminals 24. Simultaneously, the metal shutter 28 of the female connector 2 is further turned to the original position by the coil spring 29. Finally, when the case 5 is fully mounted on the cradle 4, the male connector 3 is fully plugged into the female connector 2, with the metal shutter 28 in the original position as shown in FIG. 13.

In this way, at the initial plugging stage, the male and female connectors 3 and 2 are plugged at a given oblique angle through the contact between the upper wall 365 of the male metal shell 36 and the front faces 215 of the guide walls 213 of female connector 2. Since the metal shutter 28 is turned to the retreated position, there is no need for a large storage space of the metal shutter 28.

Figure 13:
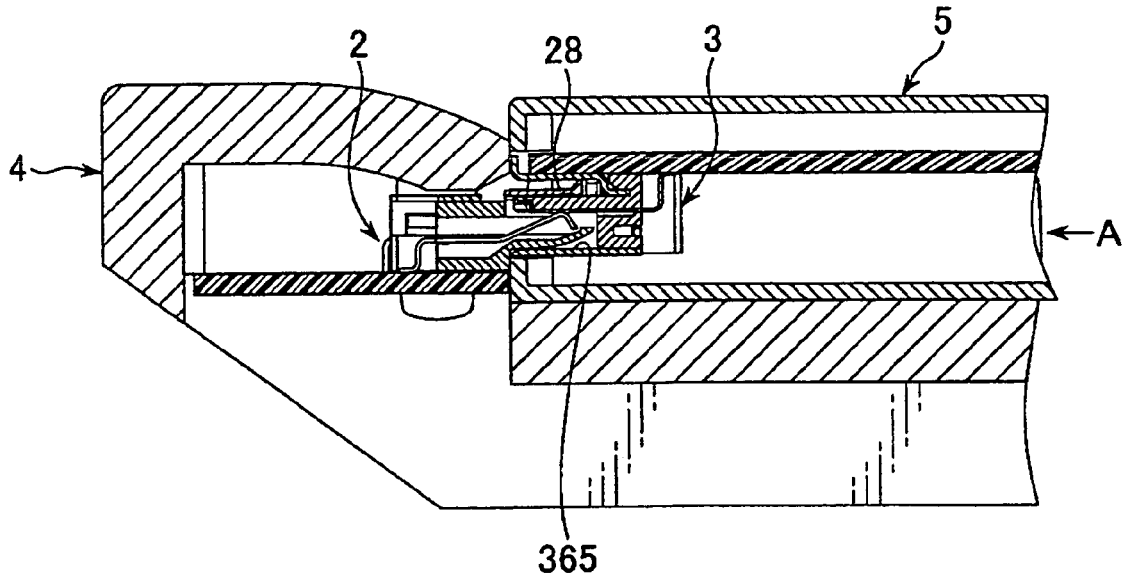
Figure 14:
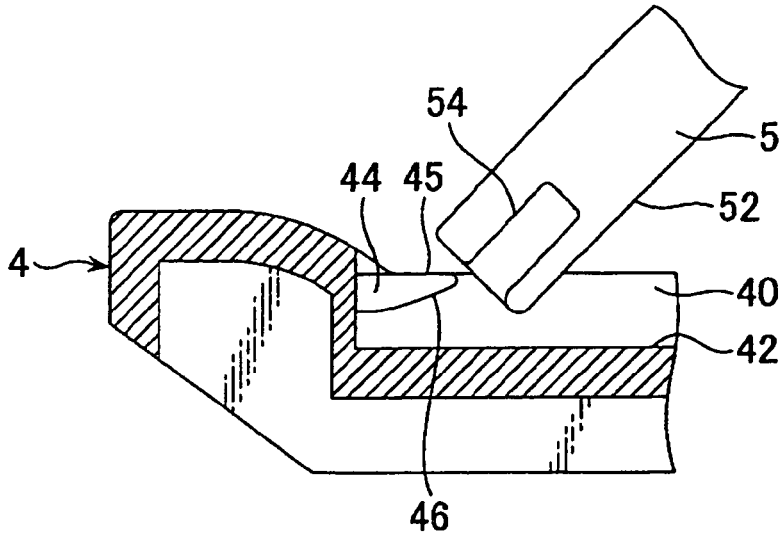
FIGS. 14–18 are sectional views showing in sequence how an axiliary mechanism regulates an angle at which the male and female electrical connectors are plugged.
Figure 15:
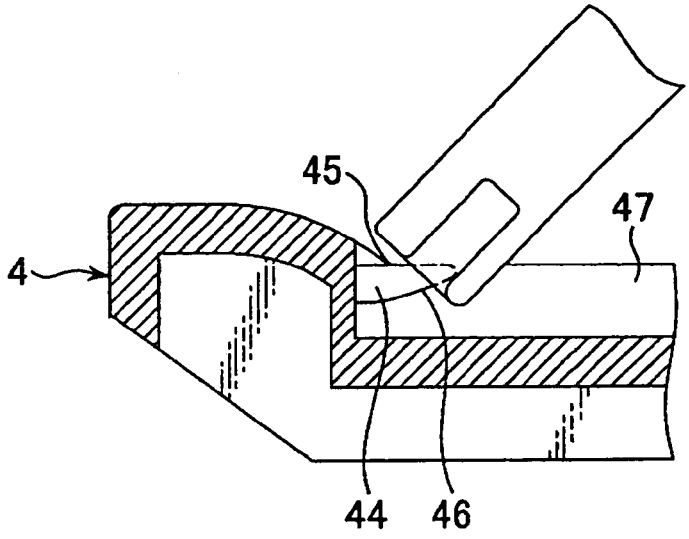
Figure 16:
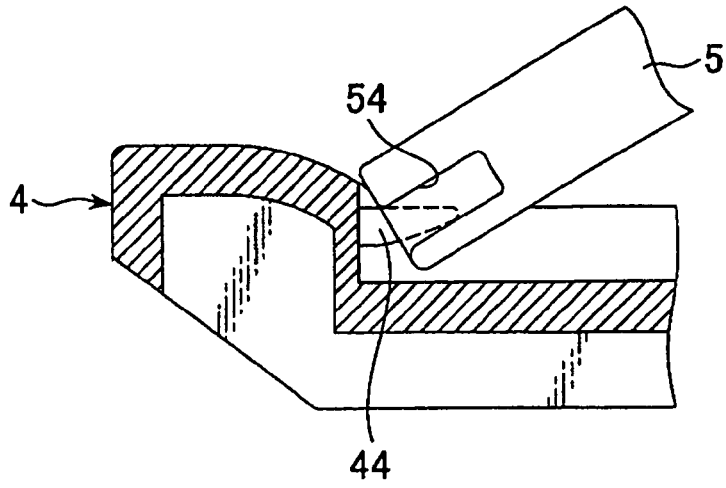
Figure 17:
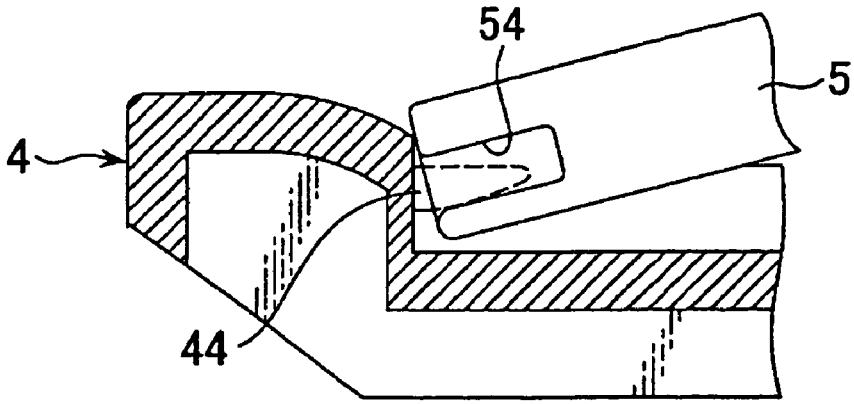
Figure 18:
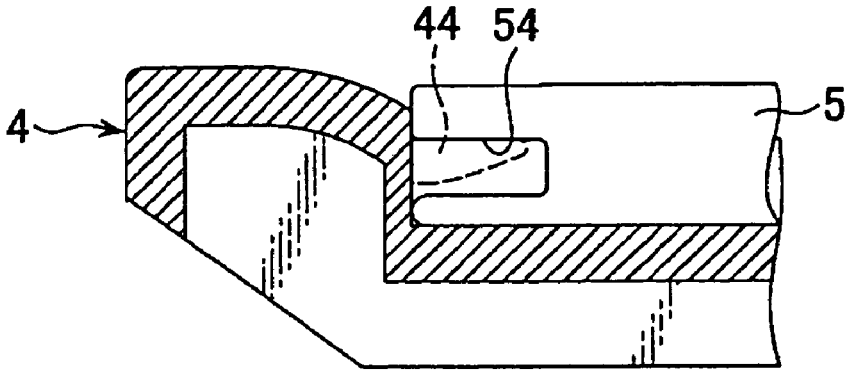

Alternatively, the case 5 may be moved along the cradle bottom 42 in the straight direction of an arrow A in FIG. 13 to directly plug the male connector 3 to the female connector 2. However, this direct plugging method makes the plugging force much higher than that of the plugging-by-turning method as described above.

5. Auxiliary Structure

The auxiliary structure for regulating the plugging angle between the male and female connectors 3 and 2 will be described with reference to FIGS. 14–18.

A rectangular recess 54 is provided in an outer wall of the case 5 for receiving at a predetermined angle a triangular rib 44 that is provide on the inner side 47 of the case receiving section 40. The triangular rib 44 has a flat top face 45 and a tapered bottom face 46. The rectangular recess 54 and the triangular rib 44 cooperate to regulate auxiliary the plugging angle between the male and female connectors 3 and 2 as shown in FIGS. 14-18. However, the plugging angle between the male and female connectors 3 and 2 is mainly determined by the contact between the front faces 215 of the guide walls 213 and the upper wall 365 of the male metal shell 36.

6. Others

It is noted that the cradle and the case are not essential for the invention. Instead of the female terminals, the male terminals or both male and female terminals may be made flexible. The invention is applicable for electrical connectors for which the initial oblique plugging operation is useful.

The invention claimed is:

1. An electrical connector apparatus consisting of first and second electrical connectors, with said second electrical connector inserted into said first electrical connector in art oblique direction and then fully plugged to the first electrical connector by turning said second electrical connector, said first electrical connector comprising:

an insulative housing, at least one contact element provided in said insulative housing, and a metal shutter pivoted to said insulative housing to cover said contact element in said insulative housing, and said second electrical connector comprising a plate member which, when said first and second electrical connectors are plugged to each other, enters between said metal shutter and said contact element, with said metal shutter being turned upwardly by said plate member of said second electrical connector.

2. The electrical connector apparatus according to claim 1, wherein said first electrical connector is secured to a first member with a regulation projection and said second electrical connector is secured to a second member with a regulation recess for engagement with said regulation projection to regulate a said angle at which said second electrical connector is inserted into said first electrical connector.

3. The electrical connector apparatus according to claim 2, wherein said first regulation member is a recess provided in said first member and said second regulation member is a raised rib provided on said second member and having a tapered face.

4. The electrical connector apparatus according to claim 1, wherein said second electrical connector further comprises:

a metal shell;

a second insulative housing connected to said metal shell to form a plugging space into which said plate member extends to divide said plugging space into first and second subspaces; and at least one second contact element provided on said plate member within said second space so that when said second electrical connector is connected to said first electrical connector, said second contact element is brought into contact with said first contact element while said metal shutter enters said first subspace of said plugging space.

5. An electrical connector apparatus consisting of a first electrical connector and a second electrical connector, said first electrical connector comprising:

an insulative housing with a pair of guide walls extending forwardly and connected by a lower curved guide face extending forwardly to provide a convex front face and at least one first contact element extending forwardly and being flexible in a direction perpendicular to a plugging direction, said second electrical connector comprising:

a plate member to define a plugging space into which said guide walls are inserted in an oblique angle at an initial plugging stage and fitted by turning said second electrical connector to a full plugging stage, and at least one second contact element extending forwardly so as to come into contact with said first contact element from said initial plugging stage to said full plugging stage.

6. The electrical connector apparatus according to claim 5, wherein said first electrical connector further comprises a metal shutter rotatably attached to said insulative housing to cover said first contact element, said metal shutter being turned upwardly by said plate member of said second electrical connector so as to permit said plate member to enter between said first contact element and said metal shutter.

7. The electrical connector apparatus according to claim 6, wherein said metal shutter is housed in said plugging space of said second electrical connector.

8. The electrical connector apparatus according to claim 5, wherein said first electrical connector is secured to a first member with a regulation projection and said second electrical connector is secured to a second member with a regulation recess for engagement with said regulation projection to regulate a said angle at which said second electrical connector is inserted into said first electrical connector.

* * * * *